United States Patent [19]

Schweitz et al.

[11] Patent Number: 4,718,203

[45] Date of Patent: Jan. 12, 1988

[54] METHOD FOR WORKING THE FUNNEL PORTION OF A CATHODE RAY TUBE

[75] Inventors: Henry A. Schweitz; Rienk Weening, both of Eindhoven, Netherlands

[73] Assignee: U.S. Philips Corporation, New York, N.Y.

[21] Appl. No.: 404,156

[22] Filed: Aug. 2, 1982

Related U.S. Application Data

[63] Continuation of Ser. No. 273,546, Jun. 15, 1981, abandoned, which is a continuation of Ser. No. 45,510, Jun. 4, 1979, abandoned.

[30] Foreign Application Priority Data

Jun. 5, 1978 [NL] Netherlands ..... 7806070

[51] Int. Cl.[4] ..... B24B 9/12

[52] U.S. Cl. ..... 51/283 E; 51/227 R; 313/364; 269/217; 445/1

[58] Field of Search ..... 51/98 R, 110, 119, 120, 51/125, 216 R, 216 T, 217 R, 217 T, 227 R, 237 R, 283 R, 283 E, 107, 131.1, 131.3; 65/61; 29/25.19; 269/321 T; 313/477 R, 364

[56] References Cited

U.S. PATENT DOCUMENTS

| | | | |
|---|---|---|---|
| 1,307,011 | 6/1919 | Kohn | 51/217 R |
| 1,369,454 | 2/1921 | Mathy | 51/227 |
| 1,833,359 | 11/1931 | Fox et al. | 51/110 X |
| 2,573,266 | 10/1951 | Melcher et al. | 269/321 T |
| 2,715,796 | 8/1955 | Beard et al. | 51/3 |
| 2,792,810 | 5/1957 | Maconeghy et al. | 269/321 T |
| 3,171,233 | 3/1965 | Doll et al. | 51/3 |
| 3,274,662 | 9/1966 | Jackman et al. | 29/25.19 |
| 3,329,422 | 7/1967 | Hajduk | 269/321 T |
| 3,364,628 | 1/1968 | Bennett | 51/227 R |
| 3,369,881 | 2/1968 | Bennett et al. | 65/61 X |
| 3,381,347 | 5/1968 | Reinwall | 51/227 R X |
| 3,456,398 | 7/1969 | Gingrich | 51/227 R X |
| 3,476,376 | 11/1969 | Jacoby | 51/227 R |
| 3,806,108 | 4/1974 | Adachi | 269/321 T X |
| 3,807,006 | 4/1974 | Segro et al. | 29/25.19 X |

*Primary Examiner*—Robert P. Olszewski
*Attorney, Agent, or Firm*—Robert J. Kraus

[57] ABSTRACT

A method of and a device for working the sealing edge of a funnel portion for a cathode ray tube during a plurality of working phases. A number of funnel portions are simultaneously worked in successive working units. Each unit comprises a centering device for centering and bringing the funnel portion into a stationary working position. The funnel portions are simultaneously transported from one unit to another by a common transport device.

6 Claims, 18 Drawing Figures

METHOD FOR WORKING THE FUNNEL PORTION OF A CATHODE RAY TUBE

This is a continuation of application Ser. No. 273,546 filed June 15, 1981 which is a continuation of Ser. No. 045,510 filed June 4, 1979, both now abandoned.

BACKGROUND OF THE INVENTION

The invention relates to a method of working the funnel portion of an envelope for a cathode ray tube, said funnel portion consisting of a conical portion and a neck portion. The funnel portion is supported and positioned at the level of two parallel, axially-spaced centering planes, so that the connecting line between the centers of the two centering planes forms the center line of the funnel portion. The funnel portion is blocked against rotation and subsequently a sealing edge is formed by grinding of the free edge of the funnel portion. The procedure is such that the plane of the sealing edge is at right angles to the center line of the funnel portion.

A method of this kind is known from U.S. Pat. No. 3,456,398. According to this known method, centering is realized at two centering planes by contacting the inner circumference of the funnel portion. Due to variations of the wall thickness and the interior dimensions, the centering planes are not accurately determined, which causes poor reproductibility and poor dimensional accuracy of the worked funnel portion, notably in the axial direction. Moreover, the inner circumference of the funnel portion is not available for use in positioning the tube during a later treatment such as the sealing of a face plate to the funnel portion. Because both centering planes are situated on the conical portion, the neck portion is not taken into account. The centers of the conical portion in the two centering planes determine only the center line of the conical portion and not the center line of the entire funnel portion, i.e. the combined conical and neck portions.

SUMMARY OF THE INVENTION

The invention has for its object to eliminate the described drawbacks and to minimize the adverse effects of all thickness variations and elastic deformation during manufacture.

This object is achieved in accordance with the invention mainly in that the funnel portion is supported in a centering manner, its free edge to be worked being directed upwards. The support is applied in one centering plane at three centering points on the outer circumference of the conical portion having a predetermined diameter and at the level of a first reference plane for the positioning of a deflection coil to be mounted at a later stage. The funnel is clamped in a centering manner in the other reference plane at three centering points on the outer circumference of the neck portion at the level of a second reference plane for the positioning of an electron gun to be inserted at a later stage. The three centering points in each centering plane form the corner points of imaginary centering triangles, the center line of the funnel portion being defined as the connecting line between the centers of the circumscribed circles of the two centering triangles.

When the funnel portion is positioned in each centering plane at three points on the outer circumference in accordance with the invention, the center line of the funnel portion can be accurately determined and a sealing edge can be ground perpendicularly to the center line with very narrow tolerances in a reproducible manner. The sealing edge is to be understood herein to include the complete end face of the conical portion as well as the face formed by (preferably three) cams projecting laterally from the end face of the conical portion. Moreover, the funnel portion can be positioned at the same centering points during subsequent working stages, so that thickness variations are eliminated and the dimensional accuracy and the reproducibility of the funnel portion are increased.

The term "the same centering points" is to be understood to mean herein contact points which are situated within a circle having a diameter of 1 mm.

Because the conical portion is centered at the level of a first reference plane for the positioning of a deflection coil and the neck portion is centered at the level of a second reference plane for the positioning of the deflection coil and of an electron gun, the dimensional accuracy and the reproducibility of the envelope and the cathode ray tube to be assembled are also improved. If the components required for assembling an envelope of a cathode ray tube, i.e. screen, gun and deflection coil, satisfy equally severe requirements as far as dimensional accuracy is concerned, all components are compatible and can be exchanged and an arbitrary funnel portion with an arbitrary face plate and gun with an arbitrary deflection coil can be assembled to form an envelope for a cathode ray tube having a very high dimensional accuracy.

The funnel portion is supported in the one centering plane on three centering points on the outer circumference of the conical portion, the three centering points being situated on a circle having a predetermined diameter. In practice, the diameter is choose to be as large as possible, the angle of inclination of the conical portion also being taken into account. In practice, preference is given to an angle of inclination of between 30° and 60° ; the diameter to be predetermined depends on the dimensions and the shape of the conical portion. Furthermore, the distance between the two centering planes should be chosen to be as large as possible.

The method in accordance with the invention can be used to work funnel portions of various dimensions and shapes. A preferred method in accordance with the invention, uses positioning means provided on the outer circumference of the conical portion, at the first reference plane where the deflection coil will subsequently be located, for centering the funnel portion in the one centering plane.

The positioning means at the first reference plane are constructed as shoulders, cams etc. The funnel portion is positioned on three of these elements. If the positioning means are shaped as a centering ring or positioning ring, the funnel portion is positioned on three points of this ring.

The funnel portion is subjected to comparatively large forces during the grinding operation. The resultant deformation of the comparatively flexible conical portion could prevent the desired accuracy from being reached as far as smoothness and perpendicularity of the sealing face are concerned. These drawbacks are eliminated in a preferred method in accordance with the invention in that the funnel portion is supported during the working on the outer circumference of the conical portion by supporting means which are independent of the centering and which counteract deformation of the funnel portion, and which also blocks this portion against rotation. The invention clearly separates supporting and centering, which has a favorable effect on tolerances and reproducibility.

A further preferred method in accordance with the invention is characterized in that it comprises a pre-grinding phase, a finishing grinding phase and a polishing phase for working the sealing edge to be flat, a working phase for beveling the borders of the sealing edge, and a working phase for grinding positioning cams on the outer circumference of the conical portion to be flat. By grinding of the sealing edge in three phases, a sealing edge having the required accuracy can also be ground when a comparatively large amount of material is removed; as a result of the beveling of the borders of the sealing edge, the susceptibility of fracturing of the sealing edge is reduced. The positioning cams on the outer circumference of the conical portion are ground in planes parallel to the already defined center line of the funnel portion.

According to the final preferred method in accordance with the invention, the funnel portion is ground to the desired length during the finishing grinding phase, the desired surface quality being realized during the polishing phase. Because the funnel portion is positioned in the one centering plane on the same three centering points on the outer circumference of the conical portion during all working phases, the funnel portion can be ground to the required length in an accurate and reproducible manner. Length is to be understood to mean herein the distance between the plane of the ground sealing edge and said centering plane.

It is to be noted that from the U.S. Pat. No. 3,381,347, it is known to ground a conical portion to a predetermined length. The conical portion is positioned in a first centering plane at the level of a reference plane for a deflection coil to be mounted at a later stage, and on four points at its inner circumference in a second centering plane near its free edge to the ground; during the grinding operation, the conical portion is made to rotate. Using such a comparatively inaccurate centering, and due to the rotation of the conical portion, only a comparatively poor dimensional accuracy can be realized.

A funnel portion worked by means of the method in accordance with the invention is characterized in that the plane of the sealing edge at the free edge of the conical portion is at right angles to the center line of the tunnel portion, said center line being defined as the connecting line between the centers of the circumscribed circles of imaginary triangles in two reference planes on the conical portion and the neck portion for the positioning of a deflection coil. The sealing edge of a funnel portion in accordance with the invention has a flatness of better than 0.1 mm, the angular deviation of the plane of the sealing edge with respect to the center line of the funnel portion being smaller than 0.03°; the length of the funnel portion is accurate within a tolerance of ±0.02 mm.

Because the same centering planes and the same centering points on the outer circumference of the funnel portion are used for assembling the envelope for a cathode ray tube, an assembled envelope of this kind has a dimensional accuracy which equals that of the funnel portion itself.

The invention also relates to an apparatus for performing the method in accordance with the invention, comprising a frame, at least one centering unit, blocking means, at least one grinding wheel whose grinding face extends at right angles to the vertical center line of the centering unit, drive means for rotating the grinding wheel, and drive means for a relative rotary movement of the grinding wheel and the centering unit about an axis which coincides substantially with the center line of the centering unit. This apparatus, in accordance with the invention, is characterized in that the centering unit comprises a centering assembly which can be adjusted as regards height, and in the transverse direction, and which comprises a centering frame provided with three supporting elements which are situated in a plane at right angles to the center line, and three centering rollers which are situated in a plane parallel to the first plane, said roller being movable and adjustable in a transverse direction with respect to the supporting elements, the supporting elements and the centering rollers forming the corners of centering triangles in the active position.

The outer circumference of the conical portion of a funnel portion to be worked bears on the three supporting elements, while the three centering rollers cooperate with the outer circumference of the neck portion. As a result of the double-three-point centering, accurate centering of the funnel portion is achieved. The connecting line between the centers of the circumscribed circles of the two centering triangles, forming the center line of the centering unit, also determines the center line of the funnel portion. Because the centering rollers can be adjusted with respect to the centering frame, the center line of the centering unit and of the funnel portion can be brought into a vertical position prior to the start of the grinding operation. The positioning of the funnel portion in the centering frame is accurately fixed. Because the centering frame can be adjusted as regards height as well as in the transverse direction, accurate positioning of the funnel portion with respect to the grinding wheel is also possible.

For executing the grinding operation, the centering unit with the centering pot and the funnel portion can be made to rotate with respect to the stationary grinding wheel. However, in a preferred embodiment of the apparatus in accordance with the invention, the grinding wheel is displaceable with respect to the centering unit in a plane at right angles to the center line of the centering unit. Because the centering unit with the comparatively heavy funnel portion remains stationary and the grinding wheel which is journalled and driven within narrow tolerances is displaced along the edge of the funnel portion to be worked, the accuracy of the grinding operation is increased.

A further embodiment of the apparatus in accordance with the invention is characterized in that it comprises four grinding wheels which are displaceable through an angle of more than 90° with respect to the center line of the centering unit. As a result of the use of four grinding wheels, a comparatively short cycle time is obtained. The displacement angle of the grinding wheels is chosen so that the working ranges of successive grinding wheels overlap. The displacement angle need only be slighly larger than 90°.

During the grinding operation, deformation of the funnel portion and displacement, shifting and/or rotation thereof must be prevented. The centering frame and the centering rollers could also be used for this purpose. However, in a further preferred embodiment of the device in accordance with the invention, the centering unit comprises four resilient supporting elements which can be blocked in an active position. As a result of this step, centering and supporting or blocking of the funnel portion are clearly separated, which benefits the dimensional accuracy.

Another preferred embodiment of the apparatus in accordance with the invention is characterized in that it comprises a plurality of centering units, each of which forms part of identical grinding units which are aligned on a common frame and which are linked by a common transport device. The grinding of the sealing edge of a funnel portion is executed in a plurality of phases on successive grinding units. Because the grinding units comprise identical centering units, the funnel portion is centered and positioned in an identical manner during each working phase, it being ensured that the funnel portion contacts the supporting elements and the centering rollers in both centering planes by way of the same contact points.

Such identical centering is possible in a further preferred embodiment of the apparatus in accordance with the invention which is characterized by a beveling unit, comprising a centering unit and four grinding wheels, each of which is rotatable about an axis transverse to the center line of the centering unit, the four grinding wheels being displaceable with respect to the center line of the centering unit. The displacement angle of the grinding wheels of this unit is again chosen so that the working ranges of successive grinding wheels overlap through a small angle.

A further preferred embodiment of the apparatus in accordance with the invention is characterized in that it comprises a cam grinding unit, comprising a centering unit and three grinding wheels, the active grinding surface of which extends parallel to the center line of the centering unit, each grinding wheel being adjustable along its axis. As a result of this step, the three cams on the circumference of the conical portion at the level of the sealing edge, being known per se, can be accurately provided with an abutment face parallel to the center line of the funnel portion. The dimensional and angular accuracy of this abutment face is important for later assembly of an envelope.

A final preferred embodiment of the apparatus in accordance with the invention is characterized in that the transport device comprises at least one carriage which is displaceable on rails and which comprises at least one support which is subject to spring force and which is slidable with respect to the carriage, said support cooperating with fixed abutments on each centering unit. By relative shifting of the support with respect to the carriage, the support with a funnel portion to be worked can be placed in the correct position with respect to the relevant centering unit. In each working unit, the funnel portion is taken over from the carrier by the centering unit.

In principle, a single carriage transporting the funnel portion from one unit to another would suffice. However, preferably use is made of a multiple carriage, so that all units can be served simultaneously, the cycle time thus being substantially reduced.

BRIEF DESCRIPTION OF THE DRAWING

The invention will be described in detail hereinafter with reference to the accompanying diagrammatic drawing.

DESCRIPTION OF THE PREFERRED EMBODIMENTS

Figure 1:
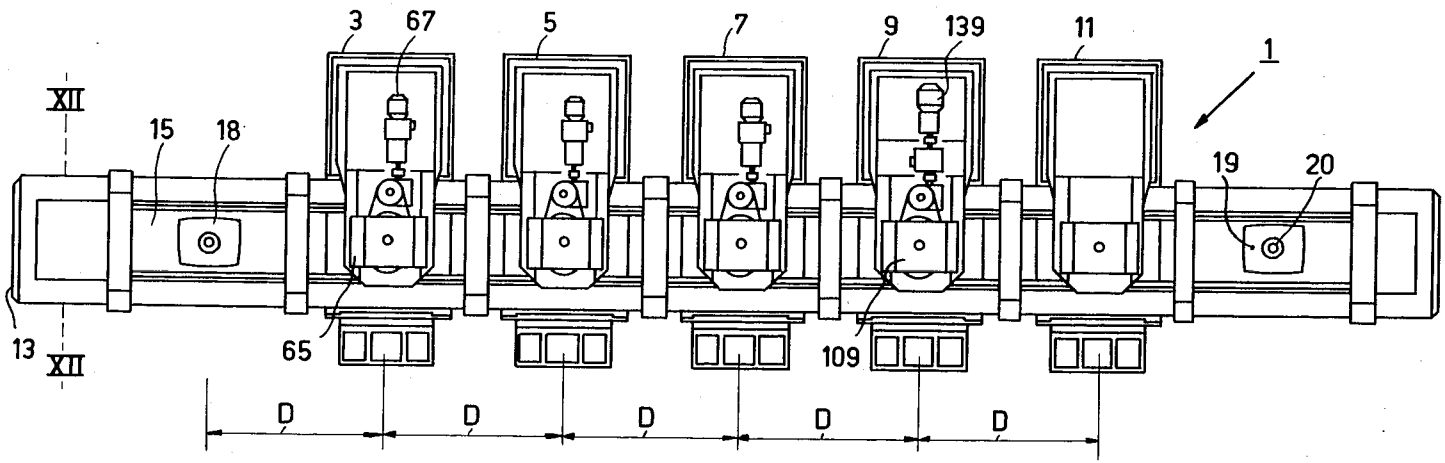
FIG. 1 is a plan view of an embodiment of the apparatus in accordance with the invention.
Figure 2:
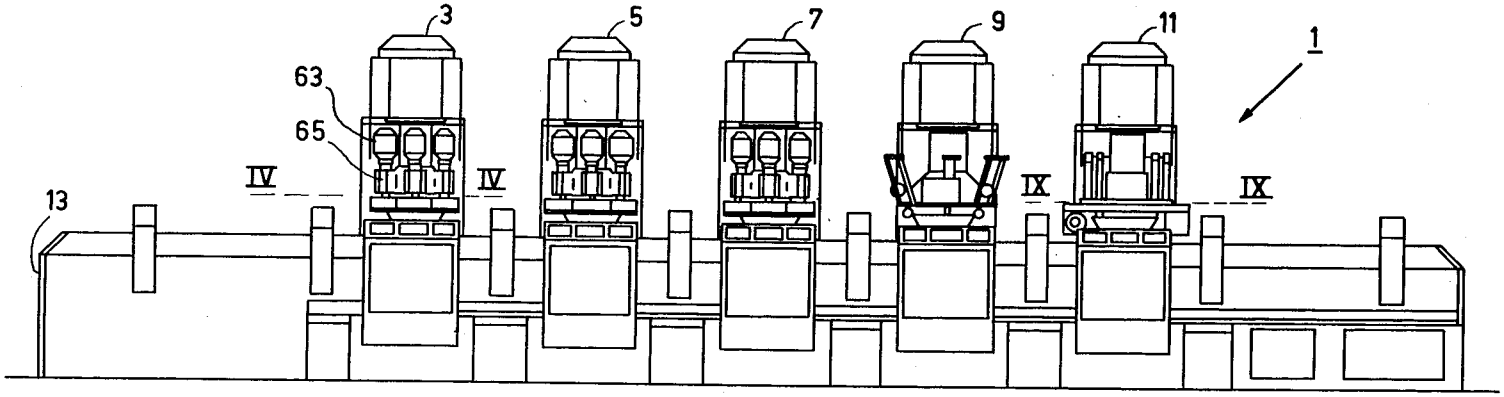
FIG. 2 is a front view of the apparatus.
Figure 3:
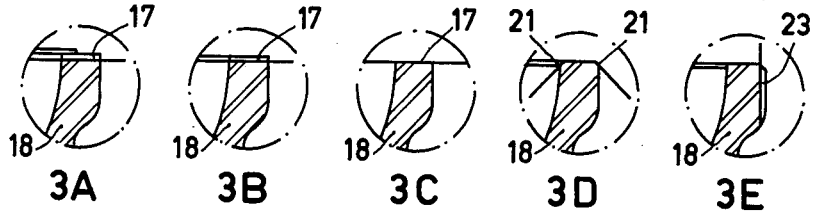
FIGS. 3*a* to 3*e* diagrammtically illustrate the various working phases.

The apparatus 1 shown in FIGS. 1 and 2 comprises a pregrinding unit 3, a finishing grinding unit 5, a polishing unit 7, a beveling unit 9, and a cam grinding unit 11. The five units are mounted on a frame 13 which comprises a common transport device 15. The units 3, 5 and 7 are identical and serve for pregrinding, finishing, grinding and polishing of the sealing edge 17 (FIG. 3) of a funnel portion 18 which is composed of a conical portion 19 and a neck portion 20 (FIG. 3) and which is intended for a cathode ray tube. In the unit 9, bevels 21 are ground on the borders of the ground sealing edge 17. In the unit 11, cams 23 known per se on the outer circumference of the conical portion, at the level of the sealing edge 17, are ground to be flat.

FIGS. 3*a* to 3*e* diagrammatically show the five working phases.

Figure 4:
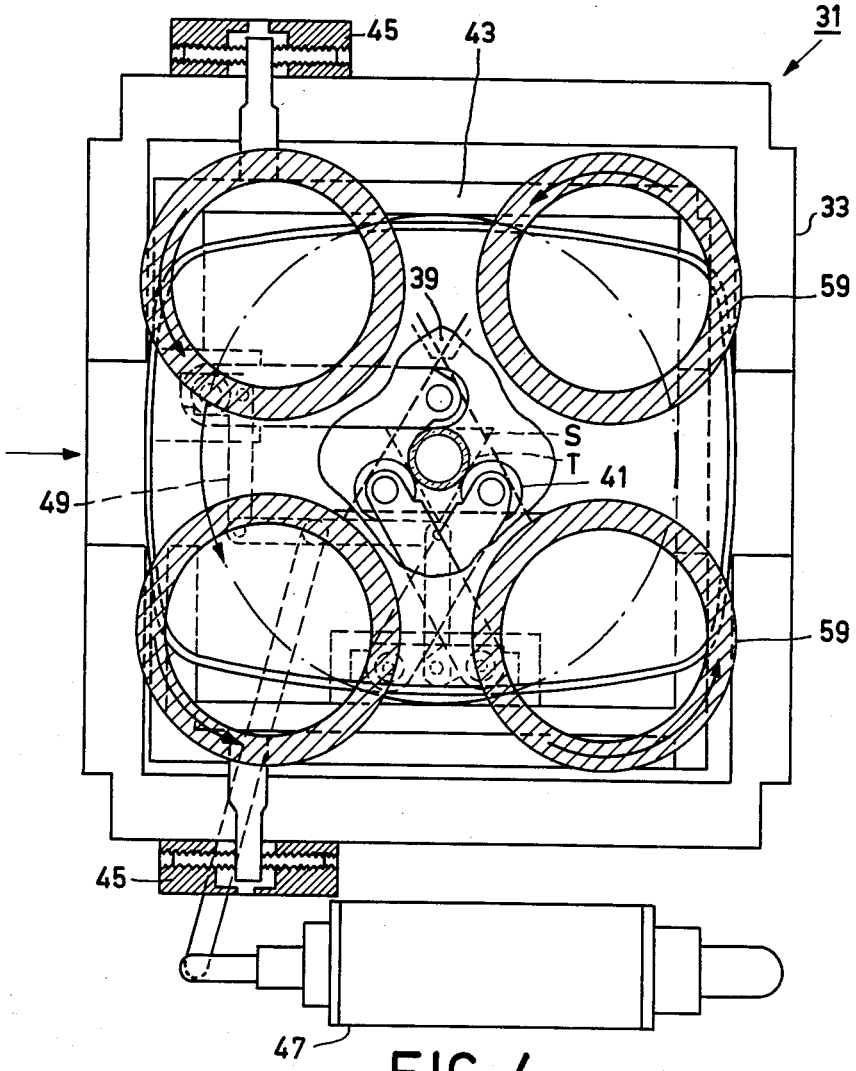
FIG. 4 is a cross-sectional view, taken along the line IV—IV in FIG. 2, of the pregrinding unit 3.
Figure 5:
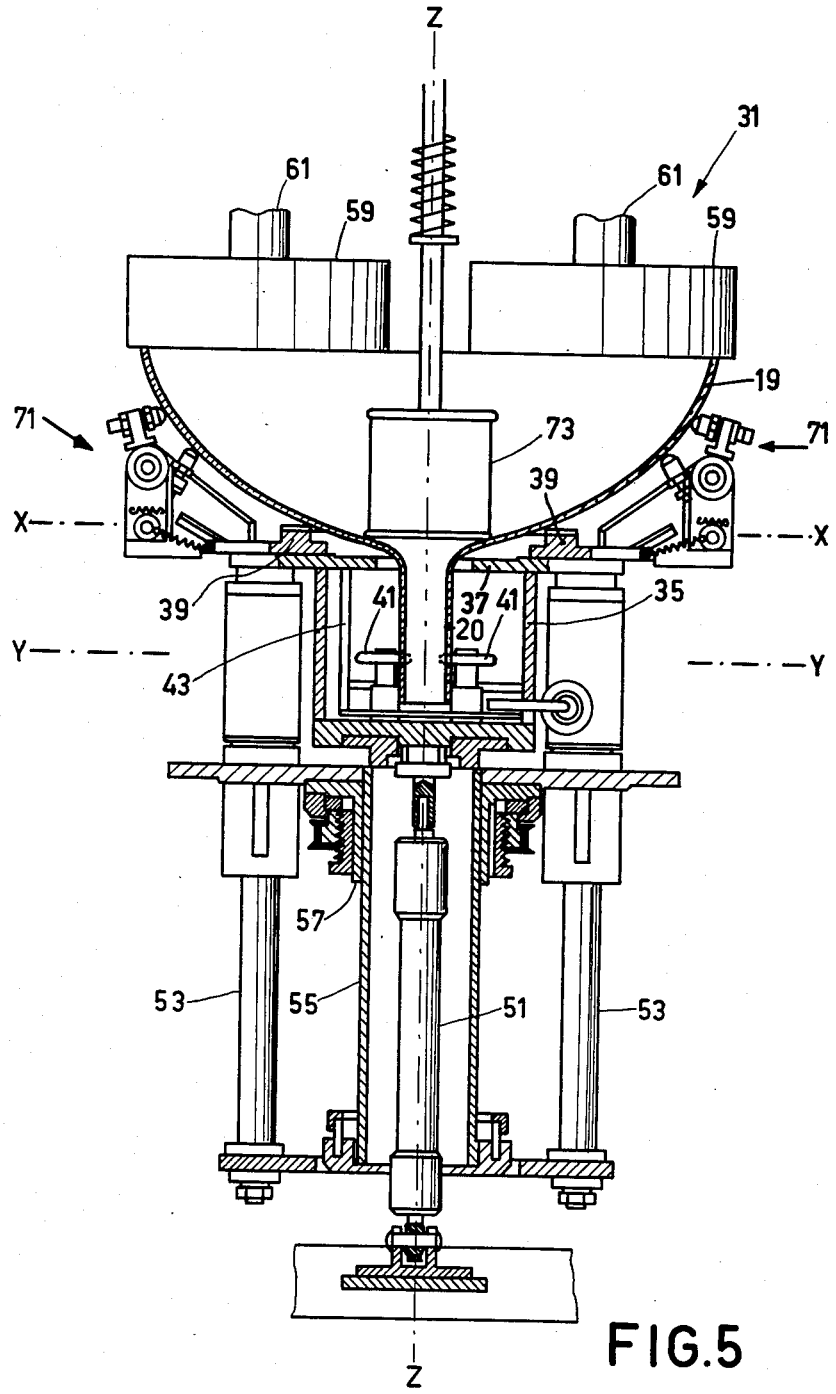
FIG. 5 is a longitudinal sectional view of the pregrinding unit.

FIGS. 4 and 5 show a centering unit 31, comprising a stationary housing 33 and a centering assembly 35 with a rigid centering frame 37 provided with three supporting elements 39 and with three centering rollers 41 which are journalled in a frame 43. Using adjusting mechanisms 45, the frame 43 with the centering rollers can be adjusted in a direction transversely of the center line Z—Z of the centering unit. By means of a hydraulic cylinder 47 and a system of rods 49, the centering rollers can, moreover, be displaced with respect to the center line Z—Z of the centering unit. The height of the centering assembly can be adjusted with respect to the frame 13. To this end, the centering assembly 35 is connected to the frame 13 by means of a hydraulic cylinder 51 and is slidably journalled on rods 53. A cylinder 55, connected to the centering assembly and cooperating with a bushing 57, also provides guiding.

The centering assembly 35 is also adjustable in the transverse direction.

The three supporting elements 39 are situated in a plane X—X, at right angles to the center line Z—Z of the centering unit. The three centering rollers 41 are situated in a plane Y—Y, parallel to the plane X—X. In the active position, the points of contact of these supporting elements 39 with the conical portion 19 and of the ceneering rollers 41 with the neck portion 20 form the corner points of centering triangles S and T.

The reference 59 denotes four grinding wheels which are journalled on shafts 61 and which are driven by separate motors 63 (FIG. 2). The grinding wheels and their individual motors are journalled in a rotary head 65 which is made to rotate by a motor 67 through an angle larger than 90° around the center line Z—Z, so that the working ranges of the grinding wheels overlap.

Each centering unit furthermore comprises four resilient supporting elements 71 which are diametrically oppositely arranged and which can be blocked in the active position. The reference numeral 73 in FIG. 5 denotes a pressure member which serves for temporarily blocking the funnel portion 18 to be worked until the supports 71 have been blocked in the active position.

Figure 6:
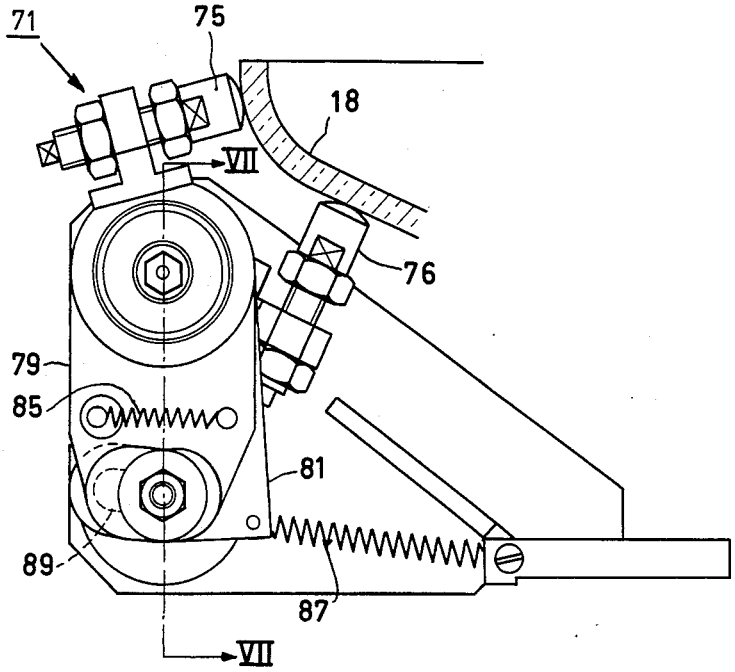
FIG. 6 is a front view of a part of the device.
Figure 7:
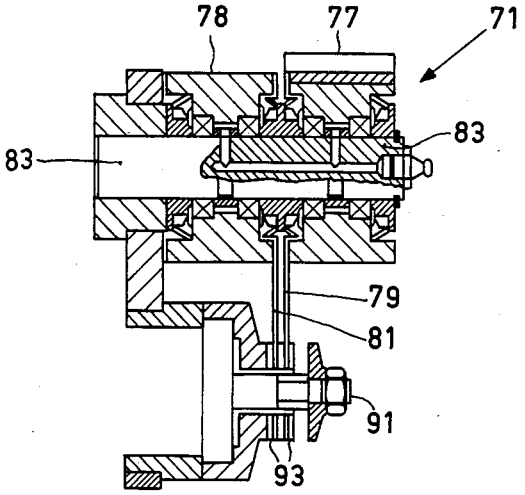
FIG. 7 is a sectional view of this part taken along the line VII—VII in FIG. 6.

The FIGS. 6 and 7 show (at an increased scale) a supporting element 71 which comprises two supporting pins 75 and 76 which are connected to bushings 77 and 78, respectively, said bushings being connected to arms 79 and 81, respectively. The bushings are rotatably journalled on a shaft 83. The arm 79 is subject to a spring 85 which tends to rotate the arm clockwise. A spring 87 tends to rotate the arm 81 counterclockwise. clockwise. Each of the arms 79 and 81 is provided with a recess 89 and is slidable with respect to a rod 91 which is displaceable in the axial direction. On the rod friction discs 93 are journalled on each side of the two arms. The arms 79, 81 with the supporting pins 75 and 76 can be blocked in the active position by displacement of the rod 91, so that the two arms are clamped between the friction discs. The rod 91 can be displaced mechanically, pneumatically or hydraulically.

The centering units of the finishing grinding unit 5 and of the polishing unit 7 are identical to the described centering unit 31. The three units 3, 5 and 7 differ only as regards the type of grinding wheel required for the relevant grinding respectively polishing operation.

The centering unit of the beveling unit 9 may also be identical to the centering unit 31; however, it does not require the supporting elements 71, because smaller forces occur during the beveling phase and because no requirements are imposed as regards the accuracy of the bevels ground, because this grinding operation serves only to remove the burrs from the ground sealing edge.

Figure 8:
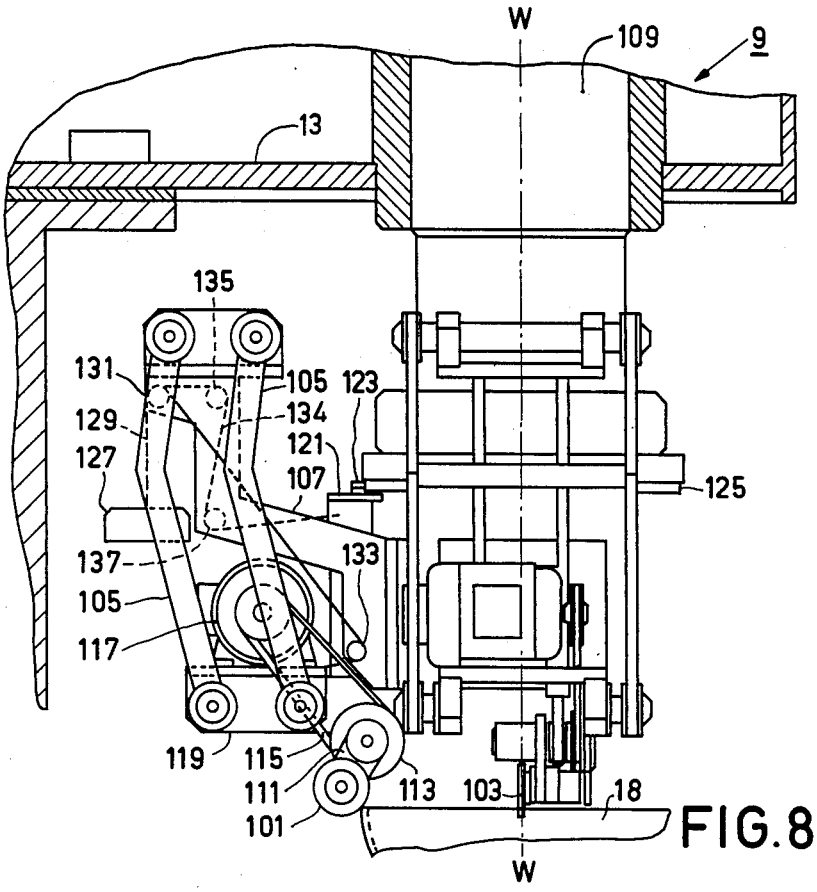
FIG. 8 is a partial sectional view and a partial side elevation of a part of the beveling unit 9.
Figure 9:
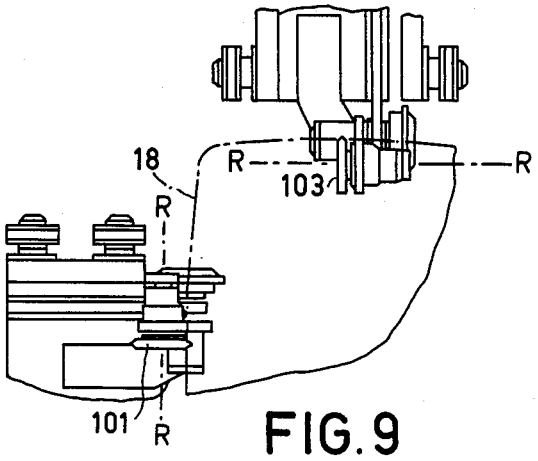
FIG. 9 is a plan view of a part of the unit shown in FIG. 8.

FIGS. 8 and 9 show a part of the beveling unit 9 which comprises four grinding wheels which are pairwise diametrically oppositely situated, the axis of rotation R—R thereof extending transversely to the center line W—W of the unit, two of the grinding wheels 101 and 103 being shown. The grinding wheel 101 is suspended from a supporting arm 107 by means of pivotable arms 105, said supporting arm being rigidly connected to a rotary head 109. The grinding wheel 101 is made to rotate, via a belt 111, a double pulley 113, and a belt 115, by a motor 117. The motor is secured on a frame 119 which is also connected to the arms 105. A supporting arm 121 which is connected to the frame 119 is provided with a cam roller 123 which cooperates with a stationary cam disc 125. A counterweight 127 is connected to the frame 119 by means of a chain or belt 129 and guide rollers 131 and 133.

The counterweight 127 tends to displace the frame 119 with the supporting arm 121 in the direction of the center line W—W of the unit, the guide roller 133 acting as a pivot the cam roller 123 being pressed against the cam disc 125 and the grinding wheel 101 being urged in the direction of the center line W—W; in cooperation with the cam disc 125, the cam roller 123 controls and limits the displacement of the grinding wheel 101 in the radial direction with respect to the sealing edge to be worked.

The grinding wheel 101, and also the diametrically oppositely situated grinding wheel not shown, serves for beveling the outer border of the ground sealing edge on the funnel portion 18 to be worked. As appears from the FIG. 9, the grinding wheel 103, and also the diametrically oppositely situated grinding wheel not shown, is for beveling the inner border of the sealing edge. The suspension and driving of the grinding wheel 103 are identical to those of the grinding wheel 101, with the exception of the suspension of the counterweight. As is shown in FIG. 8, a chain or belt 134 (denoted by a broken line) is connected, via guide rollers 135 and 137, to the supporting arm 121 so that the guide rollers 137 serves as a pivot, the cam roller 123 being displaced against the cam disc 125 and the grinding wheel 103 being urged in the opposite direction.

The head 109, serving as a support for all grinding wheels and their motors, is journalled to be rotatable in the frame 13 and is made to rotate by a motor 139 (FIG. 1). The angle of rotation of the head 109 exceeds 180°, so that the working ranges of the diametrically opposite pairs of grinding wheels overlap.

Figure 10:
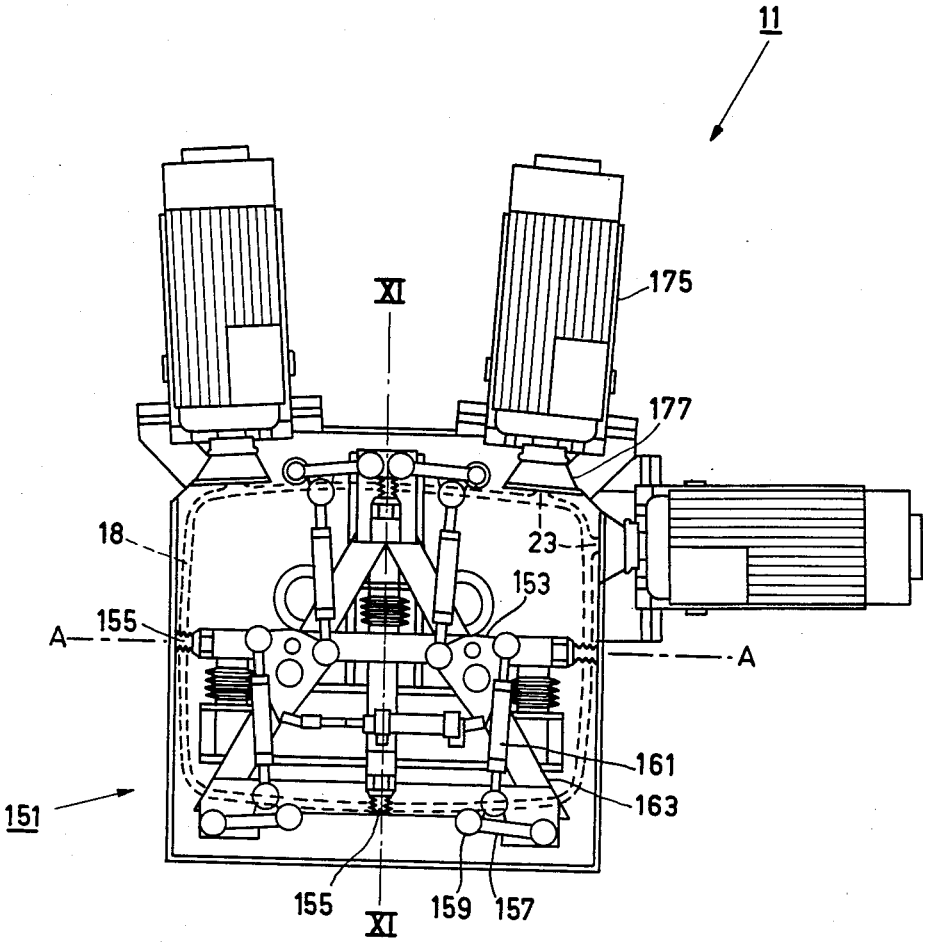
FIG. 10 is a cross-sectional view, taken along the line IX—IX in FIG. 2, of the cam grinding unit 11.
Figure 11:
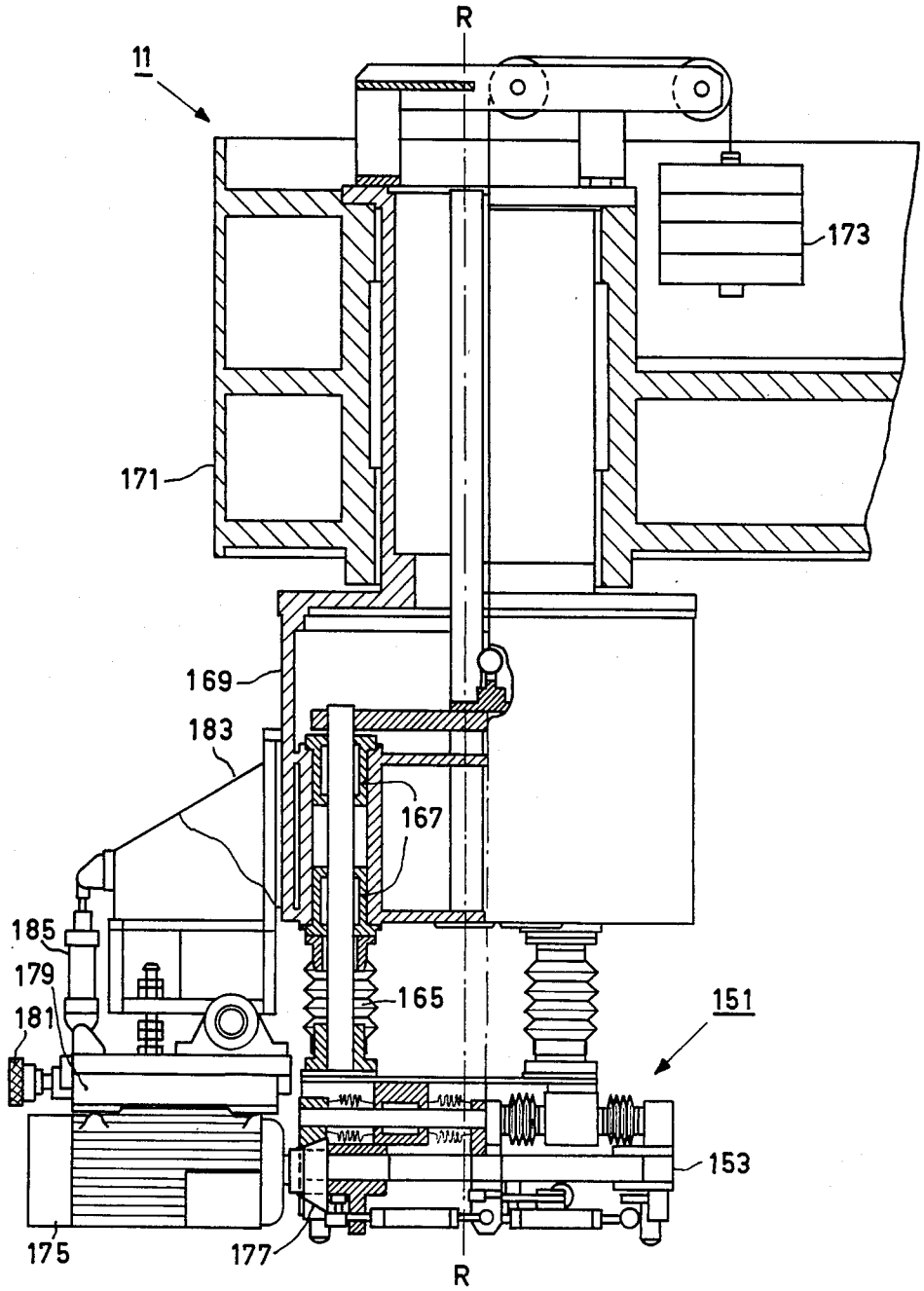
FIG. 11 is a sectional view, taken along the line XI—XI in FIG. 10, of the cam grinding unit.

The cam grinding unit 11 shown in FIGS. 10 and 11 comprises a centering unit (not shown) which may also be identical to the centering unit 31 already described; the supporting elements 71 are again not required. Because the funnel portion 18 to be worked is aligned by means of an alignment device 151, further centering by means of centering rollers is not required either. The alignment device 151 comprises mainly a frame 153 with four abutment pins 155 which are diametrically oppositely situated and four pivotable arms 157 with abutment cams 159. The arms 157 are connected, by means of rods 161, to levers 163 which are displaced by means of a hydraulic cylinder 165. The alignment device 151 is displaceable in the vertical direction and is for this purpose suspended from four rods 165 which are guided in bushings 167 in a house 169 which is mounted on the frame 171 of the unit 11. The alignment device is balanced by a counterweight 173. At the level of the three cams 123 known per se on the funnel portion 18 to be worked, there are suspended three motors 175, each of which comprises a grinding wheel 177, the active grinding face of which extends parallel to the center line R—R of the unit 11. Each motor 175 is journalled on a slide 179 and is adjustable in the axial direction by means of a micrometer screw 181. The motors are suspended to be tiltable on carriers 183 and their tilting movement is controlled by hydraulic cylinders 185.

The alignment device 151 serves to align the funnel portion 18 so that the long axis on the open end of the tunnel portion is parallel to or coincides with the axis A—A of the alignment device 151.

In all five units, the workpiece is positioned and centered in the height-adjustable centering device, after which it is raised to the working position in which the workpiece is blocked and remains stationary. After the working operation in a unit has been completed, the workpiece is lowered again, is transported to the next unit, and is positioned and centered in the centering unit thereof.

Figure 12:
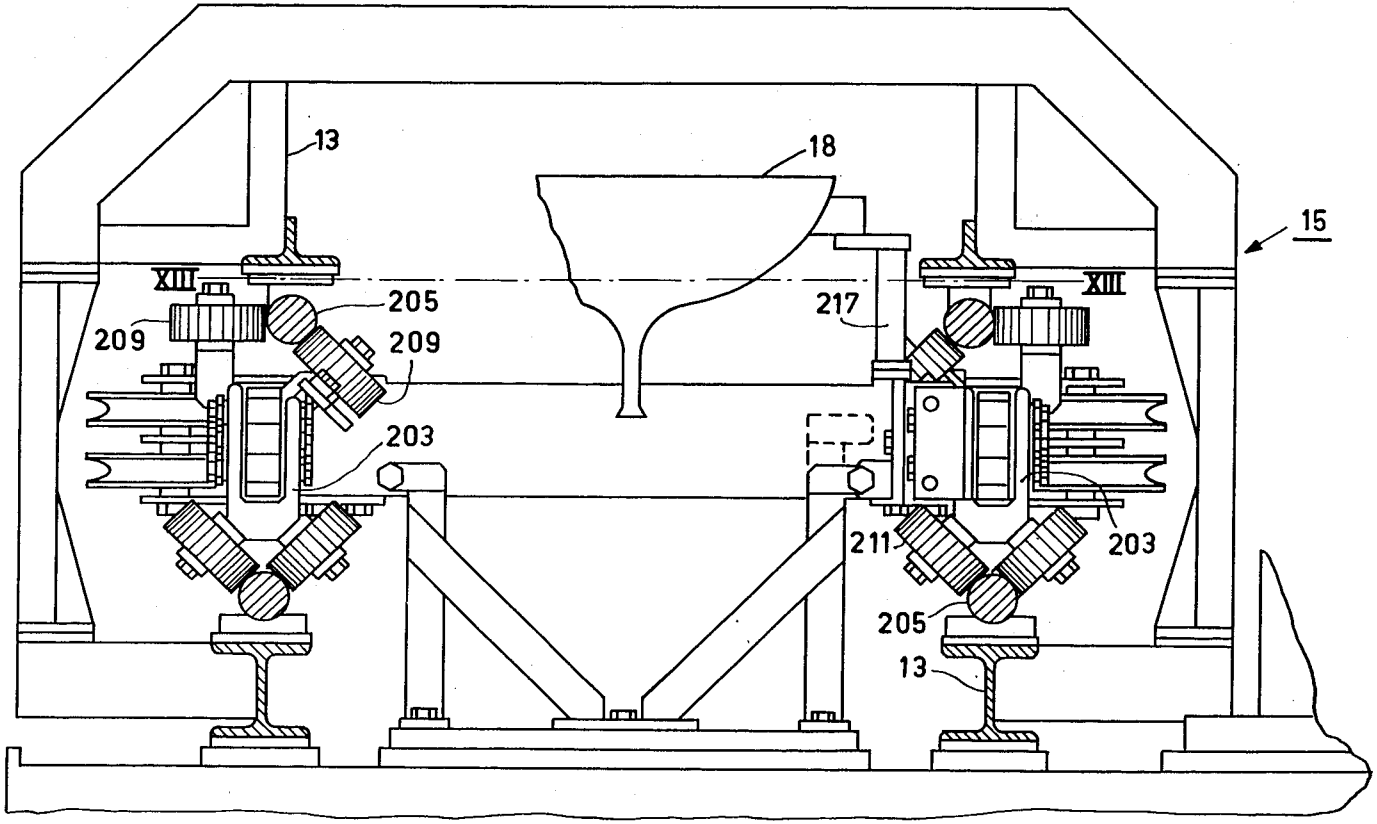
FIG. 12 is a cross-sectional view of the apparatus shown in FIG. 1, taken along the line XII—XII.
Figure 13:
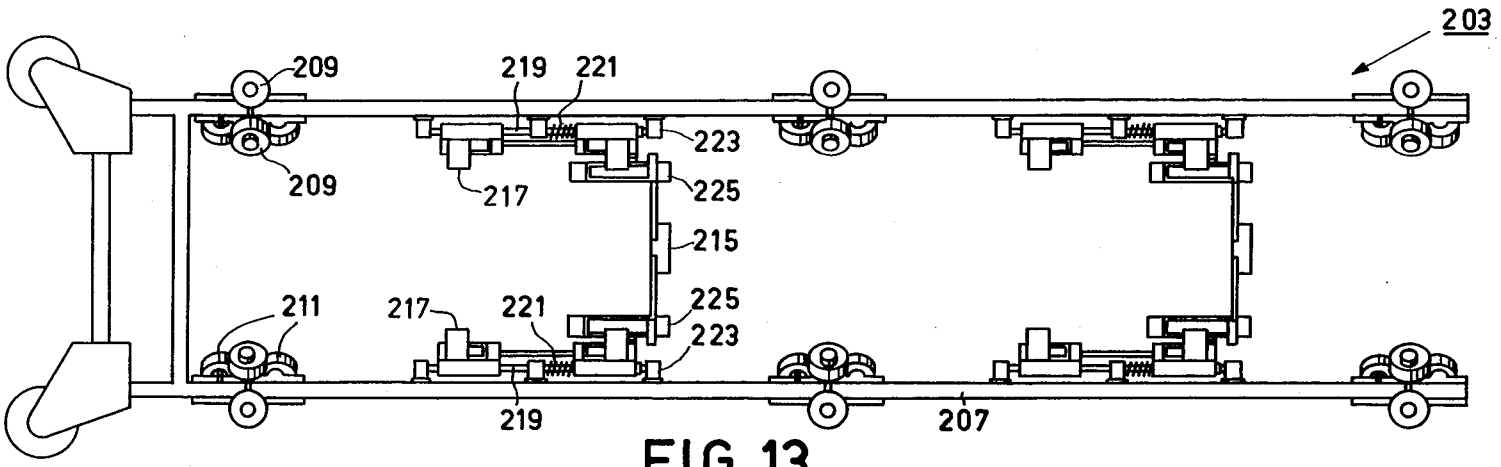
FIG. 13 is a plan view at a reduced scale, taken along the line XIII—XIII in FIG. 12 of the carriage 203.
Figure 14:
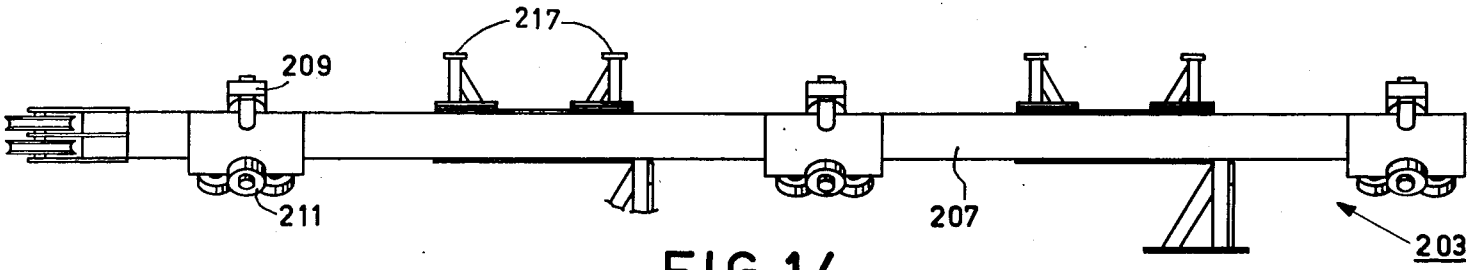
FIG. 14 is a side elevation of the carriage shown in FIG. 13.

For the feeding, the discharging and the transport of the workpiece from one working unit to another working unit, the frame 13 comprises a transport device 15 illustrated in FIG. 12 which mainly consists of a single, elongate carriage 203 which is movable on cylindrical rails 205. As shown in FIGS. 13 and 14, the transport carriage 203 mainly consists of an elongate frame 207 having an overall length which is larger than five times the distance D between the five successive working units. A plurality of rollers 209 and 211 which cooperate with the rails 205 are rotatably journalled on the frame at regular intervals. As a result of the use of four rails, by suitable positioning of the rollers and by the use of rails having a circular cross-section, a substantially playfree guiding of the carriage is achieved. The rails 205 are secured to the frame 13 and are supported at regular intervals by supports 213. Six slidable carriers 215 are arranged on the frame 207 at regular intervals which equal the distance D between successive working units. Each carrier comprises four supports 217 which are coupled to each other and which are slidable on guides 219. In the rest condition, the carriers 215 are urged against abutments 223 on the frame by springs 221.

For the transport of the workpieces, the carriage 203 is cyclically moved to and fro, the stroke being slightly larger than the distance D between the units. The carriers 215 then contact abutments on the individual centering units and come to a standstill, while the frame 207 moves slightly further. As a result, the carriers with the workpieces to be worked are accurately positioned with respect to the centering units. The workpieces are taken over, centered and put into the working position by the raising of the centering units, which are in a rest position below the level of the carriage.

For the displacement of the carriage 203, use can be made of hydraulic or pneumatic means in known manner. In the embodiment shown, the drive is realized by means of cables (not shown) which are guided around pulleys on the ends of the frame 207, one end of said cables being connected to the frame while the other end is connected to a hydraulic, pneumatic or mechanical drive.

Once a first workpiece has reached the last unit 11, an operation is performed in all units at the same time, which results in a short cycle time. After completion of the working in the unit 11, the finished product is discharged, the workpieces in the units 3, 5, 7 and 9 are transported to the next unit, and at the same time a new workpiece is fed to the unit 3.

What is claimed is:

1. A method for working a cathode ray tube funnel comprising a conical portion and a neck portion, said method comprising:

(a) supporting the funnel at three first centering points on the outer surface of the conical portion with the widest end of the conical portion facing upward, said first centering points being situated on the circumference of a first imaginary circle lying in a first reference plane defining the position at which a deflection coil will be subsequently mounted;

(b) clamping the funnel at three second centering points on the outer surface of the neck portion, said second centering points being situated on the circumference of a second imaginary circle lying in a second reference plane defining the positions at which the deflection coil and an electron gun will be subsequently mounted, the centers of said first and second imaginary circles defining a center line of the funnel;

(c) blocking the funnel against rotation; and (d) grinding the upper edge of the conical portion to a sealing edge lying in a third plane which forms a right angle with said center line.

2. A method as in claim 1, where the centering points lying in the first reference plane are the same points as will be used for the subsequent positioning of the deflection coil.

3. A method as in claim 1 or 2, where the funnel is blocked against rotation by supporting the outer circumference of the conical portion independently of the support at the centering points lying in the first reference plane.

4. A method as in claim 1 or 2, where the funnel is subjected to a number of successive manufacturing phases while being supported and clamped at the centering points lying in the first and second reference planes, respectively.

5. A method as in claim 4 including grinding phases for flattening the sealing edge for bevelling the borders of the sealing edge, and for forming flat reference surfaces on the outer circumference of the conical portion.

6. A method as in claim 5 including a phase wherein the funnel is ground to a desired length.

* * * * *